United States Patent [19]

Wiley

[11] Patent Number: 4,886,577

[45] Date of Patent: Dec. 12, 1989

[54] METHOD AND APPARATUS FOR MIXING OXYGEN GAS WITH MEDIUM CONSISTENCY PULP IN A PUMP DISCHARGE

[75] Inventor: William E. Wiley, Glens Falls, N.Y.

[73] Assignee: Kamyr, Inc., Glens Falls, N.Y.

[21] Appl. No.: 730,171

[22] Filed: May 3, 1985

[51] Int. Cl.[4] ..... D21C 9/147; D21D 5/26

[52] U.S. Cl. ..... 162/52; 162/53; 162/57; 162/65; 162/243; 261/76; 261/122; 261/DIG. 75

[58] Field of Search ..... 162/57, 65, 63, 236, 162/52, 243, 246, 66, 82, 88, 67, 53, 242; 261/DIG. 75, 122, 76

[56] References Cited

U.S. PATENT DOCUMENTS

| | | | |
|---|---|---|---|
| 3,293,117 | 12/1966 | Pennington, Jr. et al. | 162/236 |
| 3,832,276 | 8/1974 | Ruymoulik et al. | 162/65 |
| 4,427,489 | 1/1984 | Jacobson | 162/65 |
| 4,539,120 | 9/1985 | Robinson | 261/DIG. 75 |

*Primary Examiner*—Steve Alvo

*Attorney, Agent, or Firm*—Nixon & Vanderhye

[57] ABSTRACT

Oxygen delignification of paper pulp (comminuted cellulosic material in a slurry) at medium consistency (i.e., about 6–18%) is practiced without the necessity of a separate mixer. The pulp is drawn into the inlet of a fluidizing centrifugal pump capable of pumping medium consistency pulp. The pump typically has a vacuum system associated with it for effecting degassing of the pulp. As the pulp is pumped out of the pump outlet, oxygen gas is added to the pulp. This is accomplished utilizing a shear plate having a central opening and one or more radial bores, oxygen being introduced under pressure into the bores to pass into the pulp flowing through the plate central opening. A tube may be disposed in the bore(s) and have an oxygen permeable portion (such as a porous stone or sintered metal) extending into the central opening in the plate, the oxygen being introduced in the form of very small bubbles by the oxygen permeable portion.

3 Claims, 2 Drawing Sheets

STOCK OUT
10
STOCK IN
22
24
25
36
37
$O_2$
27
27'
15
12
14
20
13
19
11
18

METHOD AND APPARATUS FOR MIXING OXYGEN GAS WITH MEDIUM CONSISTENCY PULP IN A PUMP DISCHARGE

BACKGROUND AND SUMMARY OF THE INVENTION

Oxygen delignification of paper pulp at medium consistency (i.e., 6–8%) has become increasingly popular since it has been found to be particularly advantageous in many applications. In a typical medium consistency oxygen delignification system, it is necessary to provide a mixer (such as MC® mixer sold by Kamyr, Inc. of Glens Falls, N.Y.) that is capable of effectively dispersing oxygen into the pulp slurry. The slurry is then subseqently pumped to additional treatment stages, such as additional bleaching stages, pulp storage, a washing stage, or the like.

According to the present invention, a method and apparatus for effecting oxygen delignification of paper pulp is provided that reduces the capital cost of the system, while still providing for effective treatment. These desirable results are accomplished according to the invention by eliminating the mixing that has been considered necessary in order to properly disperse oxygen gas into the pulp, instead providing for the introduction of the oxygen gas into the discharge of a fluidizing centrifugal pump for pumping the pulp slurry.

According to one aspect of the present invention, an apparatus for facilitating oxygen delignification of a medium consistency finely comminuted cellulosic fibrous material slurry (paper pulp) is provided. The apparatus includes a fluidizing centrifugal pump having a housing with a pulp inlet and a pulp outlet, and an impeller disposed within the housing for pumping pulp from the inlet to the outlet. The apparatus further includes means for introducing oxygen gas into the pulp as it is passing out the pulp outlet. The oxygen gas introduction means preferably comprises a plate (e.g. a shear plate) affixed to the housing outlet, and having a central opening substantially concentric with the pulp outlet. One or more generally radially extending bores are provide in the plate, each at a first end thereof in communication with the central opening, and at the other end connected up to a source of oxygen gas under pressure. In order to introduce the oxygen in the form of very small bubbles, so that it is more evenly dispersed in the pulp, a tube may be provided in the bores, the tube having an oxygen permeable portion (such as a porous stone or sintered metal) extending from the bores through the central opening. The fluidizing centrifugal pump typically has a vacuum system associated therewith for degassing pulp during pumping, and the pulp inlet is connected up to a pulp reservoir vessel such as a stand pipe.

According to another aspect of the present invention a method is provided for the oxygen delignification of medium consistency (i.e., about 6–18%) pulp. The method comprises the steps of:

(a) adding caustic to the slurry;

(b) simultaneously fluidizing and degassing the slurry while centrifugally pumping the slurry; and (c) immediately after step (b), adding oxygen gas to the slurry, to effect oxygen delignification of the slurry material. Step (c) is practiced by introducing the oxygen gas through a shear plate in the discharge of a fluidizing centrifugal pump (which effects step (b)) either directly into the pulp or through an oxygen permeable material which causes the oxygen to be introduced in the form of small bubbles.

It is the primary object of the invention to provide for the simple, yet effective, oxygen delignification of pulp at medium consistencies. This and other objects of the invention will become clear from an inspection of the detailed description of the invention, and from the appended claims.

DETAILED DESCRIPTION

Figure 1:
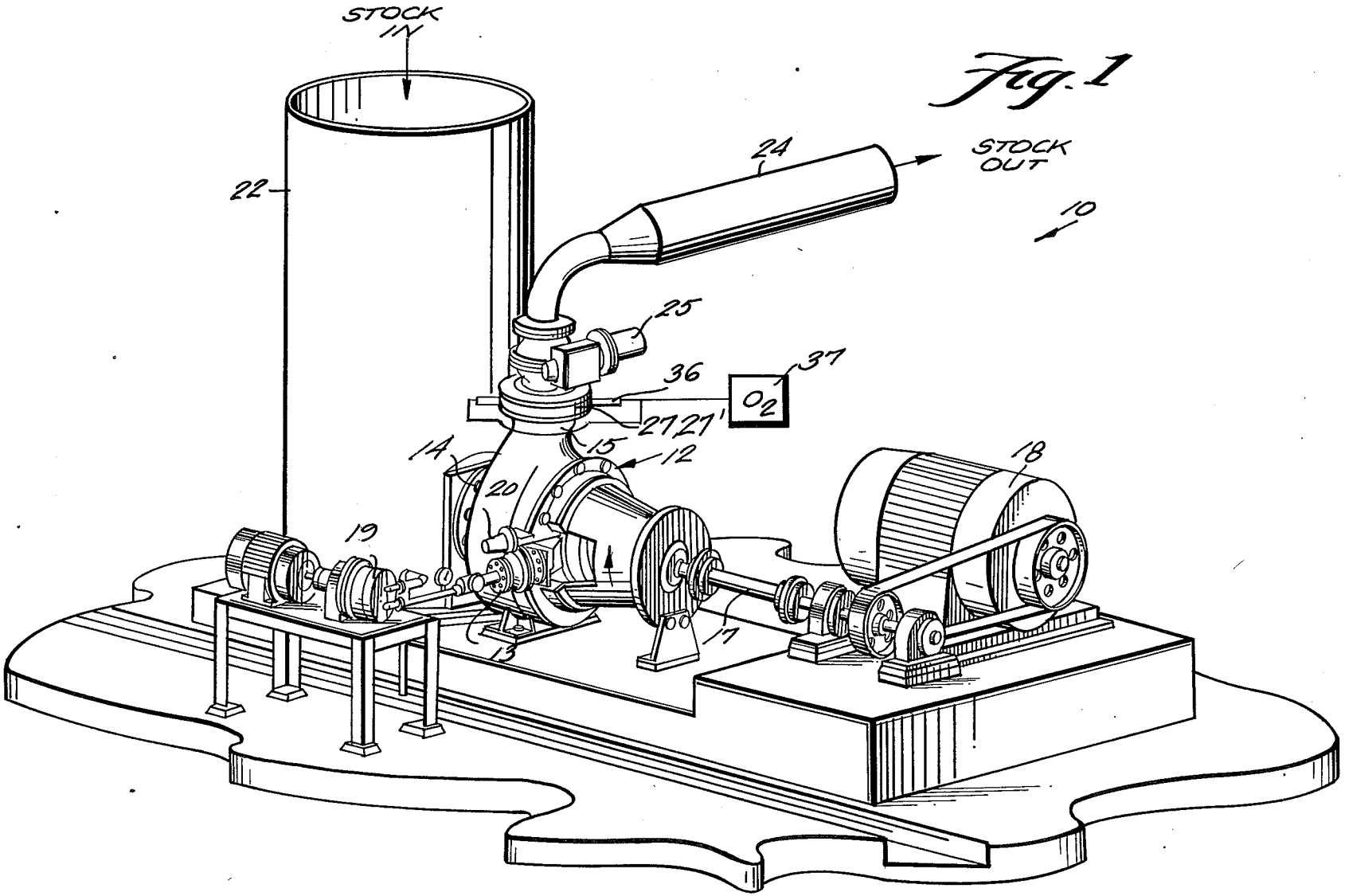
FIG. 1 is a perspective view of an exemplary system according to the present invention.

An exemplary system for effecting the oxygen delignification of finely comminuted cellulosic fiberous material in a slurry (e.g. paper pulp) is illustrated generally by reference numeral 10 in FIG. 1. The main component of this system 10 comprises the fluidizing centrifugal pump 12. Typical centrifugal fluidizing pumps that may be utilized as pump 12 are shown in U.S. Pat. Nos. 4,410,337 and 4,435,193, the disclosures of which are hereby incorporated by reference herein. Such a pump 12 includes a housing 13 having a pulp inlet 14 and a pulp outlet 15 disposed in a dimension substantially 90° to the inlet 14. Disposed within the housing 13 is an impeller (not shown) for drawing the pulp into the housing 13 through the inlet 14, and pumping it out the outlet 15. The pump 12 also typically has associated therewith a vacuum system for effecting degassing of the pulp as it is being pumped, the vacuum system and associated degassing action being necessary in many situations if there is not enough head.

In the structure illustrated in FIG. 1, the coupling 17 is connecting up to the shaft which drives the pump and impeller, and is powered by a motor 18 or the like, the impeller being rotated at sufficient rpm to effect fluidization of the medium consistency pulp. Typical components of the vacuum system include the vacuum pump 19 and degassing control valve 20. Again, details of conventional vacuum systems are shown in the aforesaid U.S. Pat. Nos. 4,410,337 and 4,435,193.

Housing 13 is preferably connected up to a pulp storage and/or supply vessel. For instance for the embodiment illustrated in FIG. 1, the inlet 14 is bolted, or otherwise attached to, a pulp storage vessel in the form of a stand pipe 22. The outlet 15 of the pump 12 is ultimately connected to a discharge pipe 24 which leads to subsequent treatment or storage stations, the conduit 24 typically having a level control valve 25 or the like associated therewith According to the present invention, it is possible to achieve effective oxygen delignification of the pulp without the use of a mixer; rather by introducing the oxygen in a particular way in operative association with the fluidizing centrifugal pump 12, effective oxygen delignification can take place. That is, according to the invention gas is introduced into the pulp as it is passing out of the outlet 15 from the pump 12. This oxygen addition is accomplished utilizing a shear plate or the like, shown by reference numerals 27, 27' in FIG. 1.

Figure 2:
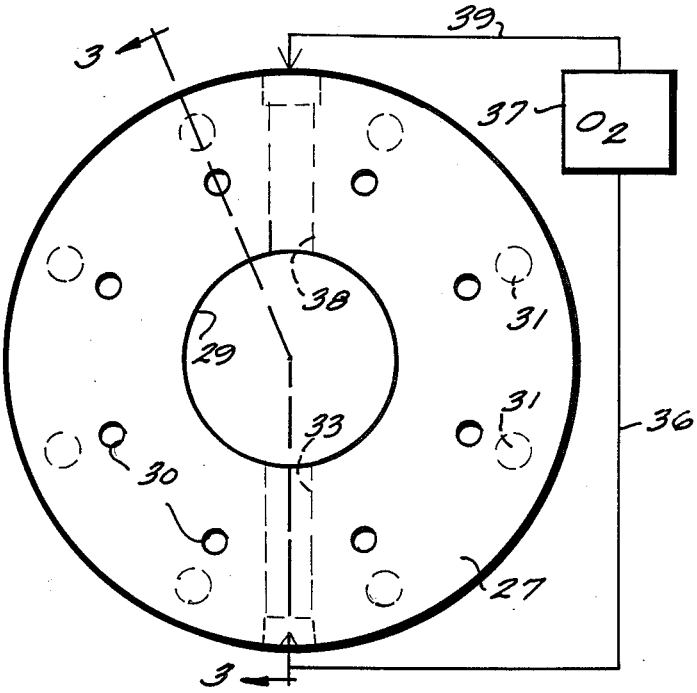
FIG. 2 is a top plan view of the shear plate of FIG. 1 connected up to a source of oxygen gas under pressure.
Figure 3:
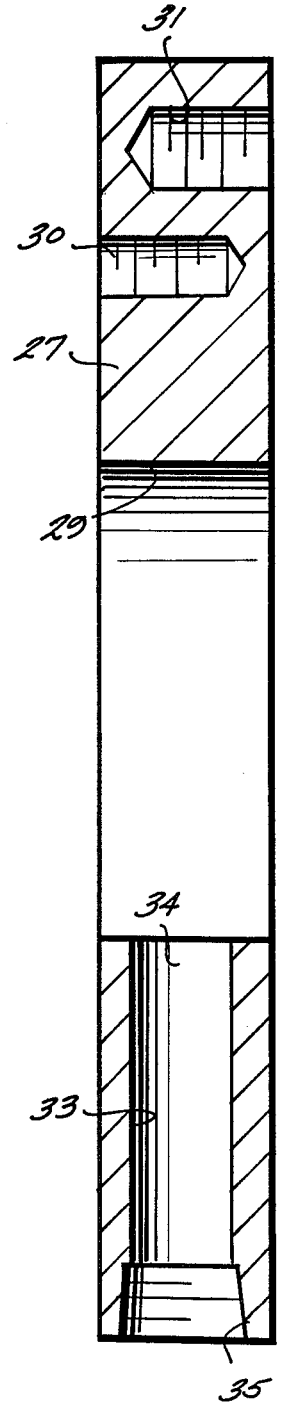
FIG. 3 is a side cross sectional view of the shear plate of FIG. 2, taken along lines 3—3 thereof.

One form the shear plate can take is illustrated in FIGS. 2 and 3. In this embodiment the shear plate 27 comprises a generally disc-shaped member having a central opening 29 therein which is substantially concentric with the outlet 15 from the housing 13. The plate 27 is bolted to a flange surrounding the outlet 15 by bolts passing into the drilled and tapped openings 30 formed in one face of plate 27. The opposite face of the plate 27 has drilled and tapped openings 31 therein which are adapted to receive bolts which operatively connect the plate 27 to the level control valve 25, discharge conduit 24, or the like.

The means for effecting introduction of oxygen into the pulp slurry flowing through the central opening 29 comprises means defining at least one generally radially extending bore 33 in the plate 27. The bore 33 is open at a first end 34 thereof and in communication with the central opening 29, and the opposite end 35 thereof is drilled and tapped for connection to a conduit leading to a source of oxygen gas under pressure, the conduit illustrated schematically at reference numeral 36 in FIGS. 1 and 2 and the source of oxygen gas under pressure being illustrated schematically at reference numeral 37. In the preferred embodiment illustrated in FIG. 2, two generally extending identical bores are provided, the bore 33 and the bore 38. The bore 38 is connected by a conduit 39 to the source of oxygen gas 37.

Figure 5:
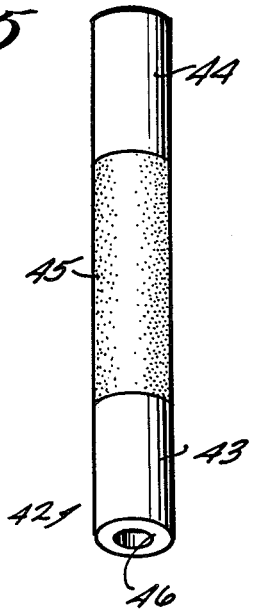
FIG. 5 is a perspective view of an oxygen introducing tube utilizable with the shear plate of FIG. 4.
Figure 4:
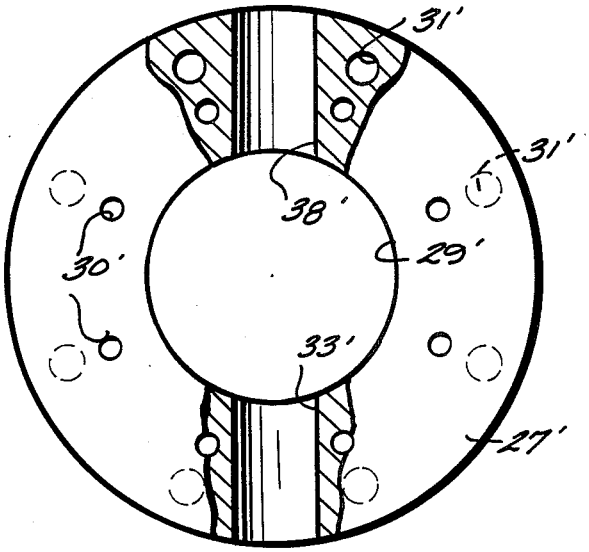
FIG. 4 is a top view, partly in cross section and partly in plan, of another embodiment of shear plate that may be utilized according to the present invention.

While the embodiment illustrated in FIGS. 2 and 3 achieves proper introduction of oxygen gas into the pulp slurry flowing through the opening 29, since the gas passes through the bores 33, 38 directly into the slurry, the oxygen is sometimes entrained in the slurry in the form of large bubbles. Smaller bubbles are more desirable, however, since they are more intimately distributed within, and mixed with, the slurry. In the embodiment illustrated in FIGS. 4 and 5, the oxygen gas is introduced in the form of much smaller bubbles than in the FIGS. 2 and 3 embodiments. In the FIG. 4 embodiment, components comparable to those in the FIG. 2 embodiment are indicated by the same reference numeral only followed by a ''''.

The shear plate 27' is connected up to the other components of the system 10 utilizing bolts passing into the openings 30', 31', and the central opening 29' is larger than the opening 29 in the FIG. 2 embodiment. The bores 33', 38' are adapted to receive a tube 42 (see FIG. 5) therewithin. The tube 42 preferably comprises first and second end portions 43, 44 of solid material (e.g. stainless steel), with a central portion 45 of oxygen permeable material. For instance, the material 45 can be a sintered metal or a porous stone, which will pass oxygen therethrough in the form of small bubbles. Such material is commercially available from Mott Metallurgical Corporation of Farmington, Conn.

The tube 42 is mounted to the plate 27' so that the ends 43, 44 are received by the bores 33', 38', respectively, with the oxygen permeable center section 45 extending diametrically through, and disposed within, the central opening 29', so that the pulp slurry flows past it in contact with it as it is discharged by the pump 12. In one exemplary embodiment, the tube 42 has an outside diameter of about 1 inch and the oxygen permeable center portion 45 is about 12 inches long (approximately the same as the diameter of the central opening 29'). Oxygen is introduced into the central passageway 46 of the tube 42 from both ends thereof, as with conduits 36 and 39, from oxygen source 37.

The invention is particularly applicable to oxygen delignification of medium consistency pulps. Medium consistency pulp has a consistency of about 6–18%, preferably about 8–15%. Of course, in order to effect the proper delignification, caustic (NaOH) must be added to the pulp at some point and typically steam is also added. The caustic can be added at a number of different points within the system 10, for instance, it can be added at the pump inlet 14, or in the conduit 24, etc.

OPERATION

In a typically operation utilizing system 10, pulp having a consistency of about 6–18% in stand pipe 22 is drawn into the inlet 14 of the housing 13 by the impeller of the pump 12. The pulp is fluidized and pumped centrifugally outwardly through the pulp discharge 15. The vacuum system, including components 19, 20, effects simultaneous degassing of the pulp during this pumping. As the pulp is flowing through the outlet 15, oxygen gas is intimately mixed with pulp by introducing the gas from the source 37 into the bores 33, 38; or alternatively by introducing the gas into the opening 46 in tube 42. The oxygen gas thus directly goes into the pulp, or in the form of small bubbles is passed into the pulp through the sintered metal or porous stone tube portion 45. Because of the condition of the pulp at the point of oxygen gas introduction, intimate mixing of the oxygen gas with the pulp takes place, and successful oxygen delignification is effected.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent methods and apparatus.

What is claimed is:

1. A method of effecting oxygen delignification of a finely comminuted cellulosic fibrous material in a slurry having a consistency of about 6–18% comprising the steps of:

(a) adding caustic to the slurry;

(b) simultaneously fluidizing and degassing the slurry while centrifugally pumping the slurry, utilizing a fluidizing centrifugal pump having a vacuum system, the pump including a housing having a slurry outlet; and (c) immediately after step (b), adding oxygen gas to the slurry, to effect oxygen delignification of the slurry material, by providing a plate having a central opening concentric with said housing outlet, and having at least one generally radially extending bore therein communicating at one end thereof with the central opening; and introducing oxygen gas under pressure into the bore to thereby pass into the slurry flowing through the central opening.

2. A system for facilitating oxygen delignification of finely comminuted cellulosic fibrous material in a slurry, comprising:

a vessel containing the slurry;

a fluidizing centrifugal pump having a housing with a slurry inlet and slurry outlet, said slurry inlet being operatively connected to said vessel;

a vacuum system for degassing the slurry as it is pumped by said fluidizing centrifugal pump from said inlet to said outlet; and means for mixing oxygen gas into the slurry, said means consisting of means for introducing oxygen gas into the slurry as it is flowing out of said pump outlet, comprising: a shear plate affixed to said housing and having a central opening substantially concentric with said outlet, and means for introducing oxygen gas into the slurry flowing through said plate central opening.

3. A system as recited in claim 2 wherein said means for introducing oxygen gas comprises means defining at least one generally radially extending bore in said shear plate, said bore in communication with said central opening at one end thereof, and connected up to a source of oxygen gas under pressure at a second end thereof.

* * * * *